US011313139B2

(12) United States Patent
Tilberg

(10) Patent No.: US 11,313,139 B2
(45) Date of Patent: Apr. 26, 2022

(54) ADJUSTABLE DOOR FRAME SPREADER TOOL

(71) Applicant: Christopher Tilberg, Ogilvie, MN (US)

(72) Inventor: Christopher Tilberg, Ogilvie, MN (US)

( * ) Notice: Subject to any disclaimer, the term of this patent is extended or adjusted under 35 U.S.C. 154(b) by 0 days.

(21) Appl. No.: 16/773,677

(22) Filed: Jan. 27, 2020

(65) Prior Publication Data

US 2020/0157823 A1 May 21, 2020

Related U.S. Application Data

(63) Continuation-in-part of application No. 14/688,390, filed on Apr. 16, 2015, now abandoned.

(60) Provisional application No. 61/980,248, filed on Apr. 16, 2014.

(51) Int. Cl.
*E04F 21/00* (2006.01)

(52) U.S. Cl.
CPC ..... *E04F 21/0015* (2013.01)

(58) Field of Classification Search
CPC ..... E04F 21/0015
See application file for complete search history.

(56) References Cited

U.S. PATENT DOCUMENTS 1,336,426 A * 4/1920 Fredericksen ..... E04F 21/0015 33/194
3,851,868 A * 12/1974 Lagasse ..... E04F 21/0015 269/8
2002/0170189 A1* 11/2002 Cheatham ..... E04F 21/0015 33/194

FOREIGN PATENT DOCUMENTS

DE 3623218 C2 * 8/1994 ..... E04F 21/0015

OTHER PUBLICATIONS

Machine Translation of DE3623218C2 by Bolte Helmut. "Installation/template system for door linings and steel cases". Aug. 11, 1994 (Year: 1994).*

* cited by examiner

*Primary Examiner* — Nirvana Deonauth
(74) *Attorney, Agent, or Firm* — Gutwein Law; Greg N. Geiser

(57) ABSTRACT

An adjustable door frame spreading tool to aid in the alignment and mounting of a hollow metal door frame. The tool includes and first end and second end connected to a collapsing/expanding middle section. The first end and the second end are bifurcated with an adjustable width of the bifurcation. Each end of the bifurcation being square and level and including a magnet for attachment to the door frame. The tool will spread the door frame and pull the door frame into alignment for attachment to an opening.

6 Claims, 2 Drawing Sheets

ADJUSTABLE DOOR FRAME SPREADER TOOL

CROSS-REFERENCE TO RELATED APPLICATION

This U.S. patent application is a continuation in part to U.S. patent application Ser. No. 14/688,390 filed Apr. 16, 2015, which claims the benefit of U.S. Provisional Application 61/980,248 filing Apr. 16, 2014, each of which the disclosure is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a spreading tool to aid in the installation of a hollow metal door frame.

BACKGROUND

Often in commercial and industrial buildings metal framing is used along with steel doors and metal door frames. A typical metal door frame is constructed to set dimensions and brought to the site where it is installed. These door frames are hollow in structure and secured in place within the structure using shims, clips, and fasteners. The installation of the door frame in a straight and square position is critical to the final usage of the door and ensures proper opening, closing, and locking.

In a typical installation, a hollow steel door frame is placed within a rough opening. The frame is then leveled, squared, and secured into place. To properly level and square the frame, often a removable spreader is used to force and hold the door frame to the proper opening width. This spreader is typically a board sized to the opening and wedged between the opposed sides of the door frame. This spreader has the ability to push the door frame to the desired opening size.

Often metal door frames have imperfections and a tendency to twist or buckle during shipping and installation causing problems in the door frame. Although, the spreader functions for its intended purpose in maintaining the proper opening of the door frame, it has short comings. The traditional spreader is not adjustable, does not have the ability to secure itself to the frame at multiple heights, does not remove or prevent imperfections and twisting during installation, and lacks the ability to pull and push the door frame to the desired installation width. Therefore, there is a need for an improved spreader to specifically aid in installation of metal door frames.

BRIEF SUMMARY OF THE INVENTION

An adjustable door frame spreading tool is disclosed. The tool aids in the installation of hollow metal door frames and is adjustable for use on frames of multiple sizes and dimensions. The tool includes a first end, a second end opposite the first end, and an expanding/collapsing middle section connecting the first end and the second end. The first end and the second end are bifurcated and configured with an adjustable width. The bifurcation being u-shaped and culminating in a pair of square ends, square generally referring to both the shape of the ends and level of the ends, wherein the square ends have a shape configured to level the door frame when affixed. The square ends having a magnet for attachment to the door frame rabbet on either side of the door stop. The bifurcation sized to straddle the door stop and allow the square ends to contact the rabbet for leveling the rabbet and frame during installation.

The collapsing/expanding middle section includes a plurality of apertures. The apertures sized to receive a pin. The apertures and pin allow for adjustment of the collapsing/expanding middle part. In the preferred embodiment of the present invention, the collapsing/expanding middle part is formed from two sections with one section telescopically and nestedly received within the other section. Accordingly, both sections will include apertures in a n alignment to receive the pin, wherein a width of the tool is adjusted by expanding or collapsing the sections and securing the width of the device with the pin.

In use, a user will determine the width of the door frame to be installed. The user will then adjust the tool to the proper width. The user will then secure to the tool to the door frame by attaching the first end and the second end to the door frame opposite each other with the bifurcations straddling the door stop to bring the stop into a square and level position. The magnets present in the square ends will secure the tool to the door frame. These magnets have adequate strength to support and secure the tool to the door frame and pull the door frame to the proper width and position if the frame is slightly out of alignment or too wide. After attachment of the tool and proper alignment of the frame, the user will secure the door frame within the opening using the appropriate fasteners. The use of the tool will ensure proper alignment and expedite the installation process.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
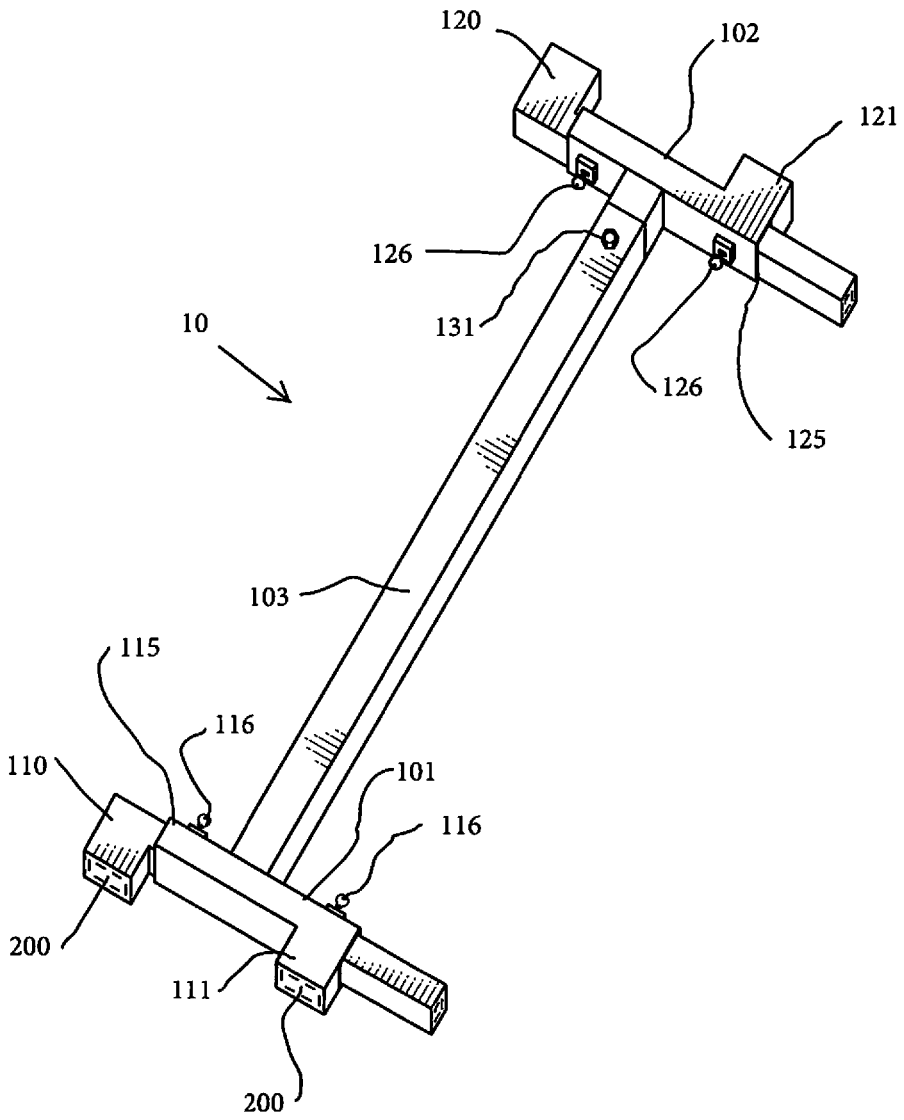
FIG. 1 is an isometric view of the adjustable door frame spreading tool, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
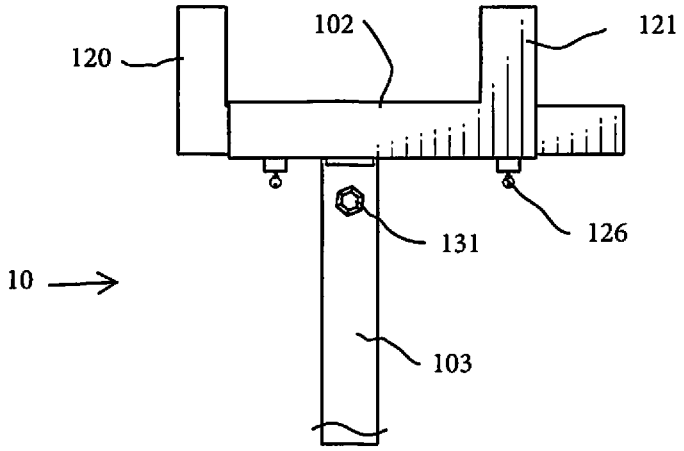
FIG. 2 is a top side view of an end of the adjustable door frame spreading tool, according to the present disclosure.
Figure 3:
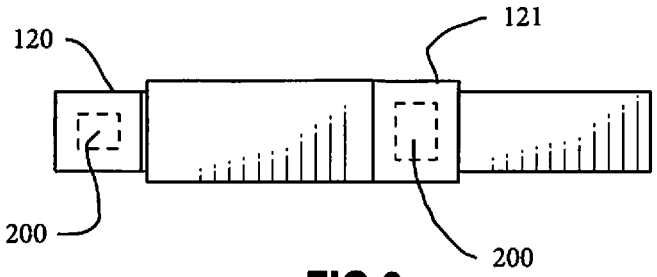
FIG. 3 is an end view of an end of the adjustable door frame spreading tool, according to the present disclosure.
Figure 4:
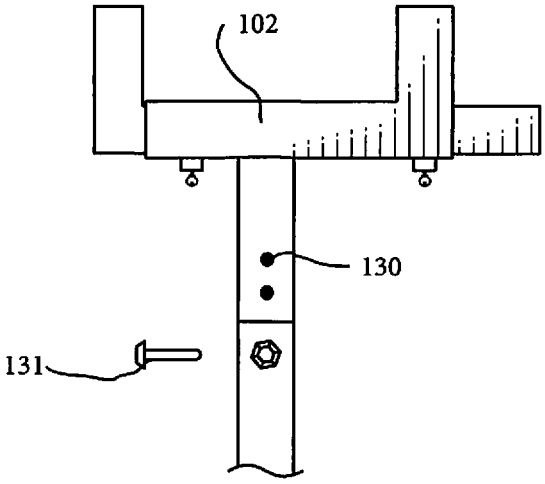
FIG. 4 is an additional top side view of an end of the adjustable door frame spreading tool showing additional features, according to the present disclosure.

Referring now to FIG. 1-4, an adjustable door frame spreading tool, generally referred to as tool device 10 is disclosed. The tool 10 is generally configured to aid in the installation of hollow metal door frames to improve installation and ensure that the frame is installed at a square and level position. Accordingly, the tool 10 is provided in a robust assembly that is durable and adjustable for use on door frames of multiple sizes and dimensions. The tool 10 includes a first end 101, a second end 102 opposite the first end 101, and an expanding/collapsing middle section 103 connecting the first end 101 and the second end 102. The first end 101 and the second end 102 are bifurcated. The bifurcation being u-shaped and culminating in a pair of square and level ends 110, 111 and 120 and 121. The square ends 110, 111, 120, 121 each having a magnet 200 for attachment to a door frame rabbet positioned on either side of a door stop. Accordingly, the bifurcation of each end is sized to straddle the door stop and allow the square ends 110, 111, 120, 121 to contact the rabbet, wherein the magnet 200 within the square ends 110, 111, 120, 121 has a strength sufficient hold the device 10 in place to pull and place the metal door frame into a level and square position. Accordingly, the square ends 110, 111, 120, 121 are coplanar and both level and square. Level and square generally being a term to indicate that the square ends 110, 111, 120, 121 are positioned at right angles, level, and perpendicular to the rabbet to push or pull the door frame to a square and plumb position with the device 10 affixed.

The bifurcation further having a width defined as the distance between the square ends 110, 111 and 120, 121, wherein this width is slidably adjustable. Accordingly, the distance between the square ends 110, 111 and 120, 121 can be adjusted to accommodate various sizes of door stops. in the preferred embodiment of the present disclosure, this slidably adjustable width is generally comprised of a mechanical coupling with one square end 110, 120 received within a sleeve 115, 125 of the ends 102, 101 and secured with at least one fastener 116, 126 configured to secure the one square end 110, 120 a fixed distance from the other square end 111, 121 apart the distance of the width of the bifurcation.

The collapsing/expanding middle section 103 includes a plurality of apertures 130. The apertures 130 sized to receive a pin 131. The apertures 130 and pin 131 allow for adjustment of the collapsing/expanding middle part 103. In the preferred embodiment of the present invention, the collapsing/expanding middle part 103 is formed from two sections with one section telescopically and nestedly received within the other section. Accordingly, a first section will include one aperture adjacent to its end and a second section will include apertures 130 along its length and aligned with the aperture of the first section to receive the pin 131, wherein a length of the tool 10 is adjusted by expanding or collapsing the sections and securing the length with the pin 131.

In use, a user will determine the width of the door frame to be installed. The user will then adjust the tool 10 to the proper length and width though movement of the collapsing/expanding middle section 103 and width of the bifurcation of the ends 101, 102. The user will then secure to the tool 10 to the door frame by attaching the first end 101 and the second end 102 to the door frame 20 opposite each other with the bifurcations straddling the door stop. The magnets 200 and shape and level of the square ends 110, 111, 120, 121 will secure the tool 10 to the door frame, wherein the shape of the square ends 110, 111, 120, 121 and magnetic strength of the magnets 200 have adequate strength to support and secure the tool 10 to the door frame and to pull the door frame to the proper width if the frame is slightly out of alignment, twisted, or too wide.

After attachment of the tool 10 and proper alignment of the frame, the user will secure the door frame within a door opening using the appropriate fasteners. The use of the tool 10 will ensure proper alignment and expedite the installation process.

In the preferred embodiment of the present invention, the tool 10 is provided in few parts and constructed from aluminum, although other similar shapes and types of materials may be used. According to this preferred embodiment, the expanding/collapsing middle section 103 is comprised of 1¼ inch angle aluminum that is nestedly received within a 1½ inch angular aluminum sleeve. Preferably, the depth of the square ends 110, 111, 120, 121 is 1¼ inches to accommodate door stop heights of several sizes and with the adjustable width of the bifurcation provides for universal usage of the tool 10. Preferably, the distance between the apertures 130 is 2 inches to allow for varying door frame widths.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A tool for an installation of a metal door frame, the tool comprising:

a first end, the first end bifurcated and defining a width between a first pair of square and level ends, each of the first pair of square and level ends being separated from each other by a slidably adjustable width via a sleeve, each end of the first pair of square and level ends being coplanar and square in shape and level, each end of the first pair of square and level ends having a magnetic surface configured to secure the tool to the metal door frame on a first pair of opposed sides of a door stop against the magnetic surfaces at a level and square position;

a second end, the second end opposite the first end, the second end mirroring the first end with the second end bifurcated and defining a width between a second pair of square and level ends, each of the second pair of square and level ends being separated from each other by a slidably adjustable width via a sleeve, each end of the second pair of square and level ends being coplanar and square in shape and level, each end of the second pair of square and level ends having a magnetic surface configured to secure the tool to the metal door frame on a second pair of opposed sides of the door stop against the magnetic surfaces of the second pair of square and level ends at a level and square position, wherein the first and second pair of opposed sides of the door stop are held at a square position in an alignment with the first end and the second end, wherein the first pair of opposed sides of the door stop is opposite the second pair of opposed sides of the door stop; and a collapsing/expanding middle section, the collapsing/expanding middle section affixed to the first end and the second end, wherein a length of the tool is adjustable by movement of the collapsing/expanding middle section.

2. A tool as in claim 1, wherein the collapsing/expanding middle section is comprised of:

a first hollow section in communication with the first end, the first hollow section having an aperture at an end opposite the first end;

a second section nestedly received within the first hollow section, the second section in communication with the second end, the second section including a plurality of apertures, the plurality of apertures aligned with the aperture of the first hollow section; and a pin, the pin received within the aperture of the first hollow section and selectively aligned with the plurality of apertures of the second section, wherein the pin restricts movement of the second section relative to the first hollow section.

3. A tool as in claim 2, wherein the first pair of square and level ends and the second pair of square and level ends each has a height, the height being one and one-quarter inches.

4. A tool for an installation of a metal door frame, the tool comprising:

a first end, the first end having a first pair of square and level ends, each of the first pair of square and level ends being separated from each other by a slidably movable adjustable width via a sleeve defining a bifurcation, each end of the first pair of square and level ends being coplanar and square in shape and level, each end of the first pair of square and level ends having a magnetic surface configured to secure the tool to the metal door frame on a first pair of opposed sides of a door stop against the magnetic surfaces at a level and square position;

a second end, the second end opposite the first end, the second end mirroring the first end with the second end having a second pair of square and level ends, each of the second pair of square and level ends being separated from each other by a slidably movable adjustable width via a sleeve defining a bifurcation, each end of the second pair of square and level ends being coplanar and square in shape and level, each end of the second pair of square and level ends having a magnetic surface configured to secure the tool to the metal door frame on a second pair of opposed sides of the door stop against the magnetic surfaces of the second pair of square and level ends at a level and square position, wherein the first and second pair of opposed sides of the door stop are held at a square position in an alignment with the first end and the second end, wherein the first pair of opposed sides of the door stop is opposite the second pair of opposed sides of the door stop; and a collapsing/expanding middle section, the collapsing/expanding middle section affixed to the first end and the second end, wherein a length of the tool is adjustable by movement of the collapsing/expanding middle section.

5. A tool as in claim 4, wherein the collapsing/expanding middle section is comprised of:

a first hollow section in communication with the first end, the first hollow section having an aperture at an end opposite the first end;

a second section nestedly received within the first hollow section, the second section in communication with the second end, the second section including a plurality of apertures, the plurality of apertures aligned with the aperture of the first hollow section; and a pin, the pin received within the aperture of the first hollow section and selectively aligned with the plurality of apertures of the second section, wherein the pin restricts movement of the second section relative to the first hollow section.

6. A tool as in claim 5, wherein the first pair of square and level ends and the second pair of square and level ends each has a height, the height being one and one-quarter inches.

* * * * *